US009770380B1

(12) United States Patent
Dalton

(10) Patent No.: US 9,770,380 B1
(45) Date of Patent: Sep. 26, 2017

(54) SELF PROPELLED WALKER

(71) Applicant: Susan Helane Dalton, Perryville, MO (US)

(72) Inventor: Susan Helane Dalton, Perryville, MO (US)

(73) Assignee: Susan Helane Dalton, Perryville, MO (US)

( * ) Notice: Subject to any disclaimer, the term of this patent is extended or adjusted under 35 U.S.C. 154(b) by 0 days.

(21) Appl. No.: 15/144,845

(22) Filed: May 3, 2016

(51) Int. Cl.
*B61H 3/00* (2006.01)
*A61H 3/04* (2006.01)

(52) U.S. Cl.
CPC ..... *A61H 3/04* (2013.01); *A61H 2003/043* (2013.01); *A61H 2003/046* (2013.01)

(58) Field of Classification Search
CPC ..... A61H 2003/043; A61H 2003/046
See application file for complete search history.

(56) References Cited

U.S. PATENT DOCUMENTS

2015/0359699 A1* 12/2015 Chang ..... A61H 3/04 701/22

* cited by examiner

*Primary Examiner* — Erez Gurari

(57) ABSTRACT

The present invention relates to a self propelled walker enabling a safe and a stable walker which moves with the user and does not compromise stability. The present invention of a self propelled walker provides wheels on all four contact points to the ground. The wheels are motorized and locking, so the user does not have to exert energy to propel the walker forward. The motors are connected to a touch screen control device and a motion sensor. The motion sensor detects the movement speed of the user to keep the walker in proper position while the user is walking. When being leaned on heavily the wheels lock, providing a stable support device.

14 Claims, 1 Drawing Sheet

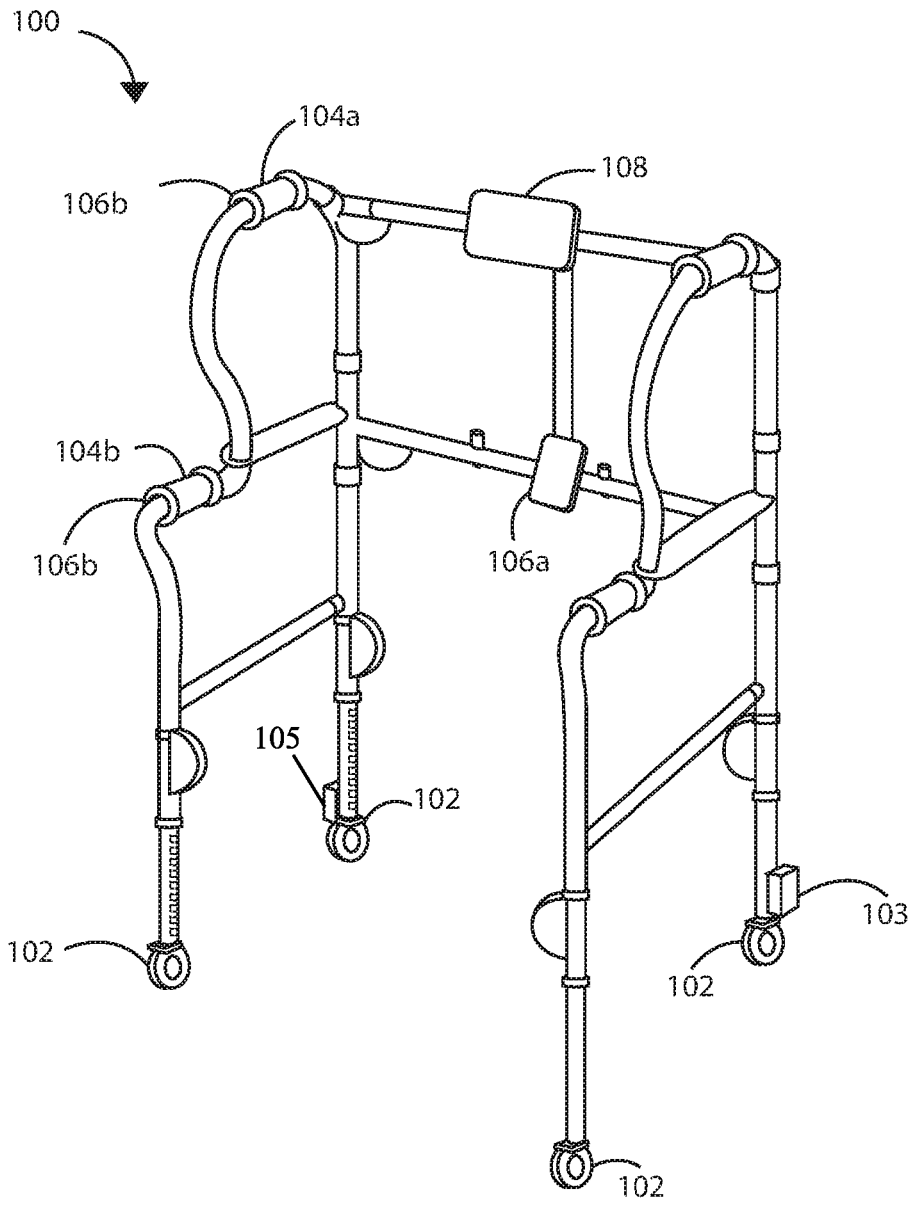
100
104a
106b
108
104b
106b
106a
105
102
102
103
102
102

SELF PROPELLED WALKER

FIELD OF THE INVENTION

The present invention relates to a self propelled walker enabling a safe and a stable walk for the user wherein the self propelled walker moves with the user and does not compromise with the stability of the user.

BACKGROUND OF THE INVENTION

In most cases the walkers feature four contact points to the ground wherein, the front two points are usually where the wheels are connected and the back are the legs wherein no wheels are coupled as well as these are static and rubber coated. These standard walkers do not slide easily and require the user to pick up the walker to move forward. This compromises some of the intended stability of these walkers. As an ad hoc solution many users will cut open a tennis ball and put it over the rear legs of the walker so it can slide easier across the floor. Though this allows the walker to scoot easier it compromises the stability of the walker when the user needs to put their weight on it and have a solid object to hold onto, also these walkers are typically not very ergonomic when it comes to assisting the user up from a seated position.

Further, standard walkers are only adjustable height wise, and usually in increments of 1 inch. Due to the importance of hand positioning for stability and the variety of body types amongst users there remains a need for a walker that is adjustable in minute increments both horizontally and vertically.

These walkers are made of lightweight material to aid in ease of use. With new technology available it is possible to add the benefit of a stable walker that moves with the user and does not compromise maneuverability.

Therefore, there remains a need to overcome above mentioned problems and our invention resolve the same.

SUMMARY OF THE INVENTION

The main objective of the invention is to overcome the prior art by providing a self propelled walker enabling a safe and a stable walk for the user wherein the self propelled walker moves with the user and does not compromise with the stability of the user.

The present invention of a self propelled walker is comprised of wheels on all four contact points to the ground. The wheels are motorized and are equipped with a locking mechanism 105, so the user does not have to exert energy to propel the walker forward. The motors are connected to a computing unit and a motion sensor. The motion sensor detects the speed of the movement of the user to keep the walker in proper position while the user is walking. When not in motion the wheels lock in place, providing a stable support device. The walker features a higher and lower set of handles too wherein, the lower handle provides a variety of ergonomic positioning for users, for example to assist them when getting up from a seated position and the higher set of handle assist the walk of the user through various pathways. Further the handles feature a sensor to detect when the user is in contact with the handles, possibly a pressure sensor. When the user's hands are not applying pressure to the handles this frees the wheels to turn, allowing the self propelled walker to be manipulated freely when not in use, for example: being pulled into position by an assistant.

Also, this self propelled walker provides a touch screen computing unit to the user wherein the user is able to adjust the height and width of this self propelled walker to customize their size to their preferred dimensions. The self propelled walker is also able to fold itself into its most compact size by use of the touch screen control pad.

BRIEF DESCRIPTION OF THE DRAWINGS

The following drawings illustrates an exemplary embodiment; however, they are helpful in illustrating objects, features and advantages of the present invention because the present invention will be more apparent from the following detailed description taken in conjunction with accompanying drawings in which:

FIG. 1 illustrates the perspective view of the given invention according to an embodiment of the invention.

DETAIL DESCRIPTION OF THE DRAWINGS

Reference will now be made in detail to the exemplary embodiment(s) of the invention, examples of which are illustrated in the accompanying drawings. Whenever possible, the same reference numerals will be used throughout the drawings to refer to the same or like parts.

References to "one embodiment," "at least one embodiment," "an embodiment," "one example," "an example," "for example," and so on indicate that the embodiment(s) or example(s) may include a particular feature, structure, characteristic, property, element, or limitation but that not every embodiment or example necessarily includes that particular feature, structure, characteristic, property, element, or limitation. Further, repeated use of the phrase "in an embodiment" does not necessarily refer to the same embodiment.

Unless defined otherwise, all technical and scientific terms used herein have the same meaning as commonly understood by one of ordinary skill in the art to which this invention belongs. Although any methods and materials similar or equivalent to those described herein can also be used in the practice or testing of the present invention, the preferred methods and materials are now described. All publications, patents and patent applications mentioned herein are incorporated herein in their entirety.

FIG. 1 illustrates the perspective view of the given invention of the self propelled walker [100] enabling a safe and a stable walk for the user wherein the self propelled walker [100] moves with the user and does not compromise with the stability of the user. Herein, in the present invention of the self propelled walker [100] comprising at least one wheel [102] and preferably four on all contact points to the ground wherein these wheels [102] provide easy movement of the self propelled walker [100] providing easy sliding of the wheels [102] across the ground and do not require the user to pick up the self propelled walker [100] to move forward. These wheels [102] are connected to a motor [103] which provides the wheels [102] with a controlled and automatic movement when given a proper command via a computing unit [108]. This computing unit [108] has a video display to provide the user with various user's options like setting a timer, displaying the distance travelled by the user, also possessing user command options such as; locking, folding, moving or stopping the self propelled walker [100] depending upon the user's need. This computing unit [108] is coupled to at least one handle wherein the self propelled walker [100] features a higher set of handles [104*a*] and lower set of handles [104*b*] wherein, the lower set of handles [104*b*] provide a variety of ergonomic positioning for users, for example to assist them when getting up from a seated position while the higher set of handles [104*a*] provides support and assistance to the user while walking. Herein, the user does not have to try to maintain balance of their body weight on the self propelled walker [100] while getting up and sitting down, and he/she is completely free to exert the full pressure upon the self propelled walker [100] while getting up and down. Further the present invention is featured with at least one sensor one is a motion sensor [106*a*] directed at the users feet and one is pressure sensor [106*b*] coupled to the handles [104*a* & 104*b*] wherein the motion sensor [106*a*] helps detect the speed of the movement of the user to keep the self propelled walker [100] in proper position while the user is walking. When not in motion the wheels [102] locked in place, providing a stable support self propelled walker [100]. The pressure sensors [106*b*] enable a controlled and stable self propelled walker [100]. For an example if the user's hands are not applying pressure to the handles [104*a* & 104*b*] this frees the wheels [102] to turn, allowing the self propelled walker [100] to be manipulated freely when not in use, for example; being pulled into position by an assistant. In addition, the user by the help of a computing unit [108] is able to adjust the height and width of this self propelled walker [100] to customize the walker size to their preferred dimensions. The self propelled walker [100] is also able to fold itself into its most compact size by enabling a command via touch screen control unit [108].

In the preferred embodiment of the given invention of the self propelled walker [100] which illustrates it's use for elderly person or for the hospital use wherein the elderly person who is not well is able to make its use for proper, safe and stable walking without facing the problem of falling while walking. In an embodiment the person who is unable to walk is provided with this self propelled walker [100] wherein the user of this self propelled walker [100] by the help of the handles [104*a* & 104*b*] providing a variety of ergonomic positioning for the users is able to get proper support while getting up or sitting down. These handles [104*a* & 104*b*] provided by the self propelled walker [100] is designed in the manner that the person is able to exert full pressure equivalent to his/her body mass at time of his/her walking, sitting or walking and making use of this self propelled walker. The handles [104*a* & 104*b*] is further provided with sensors wherein the sensors included in the given invention of the self propelled walker [100] are of two types i.e. one is the motion sensor [106*a*] and another is the pressure sensor [106*b*]. The motion sensor [106*a*] detects the movement of the user's lower body by infrared, radar or other means. This motion sensor [106*a*] examines the speed of the user and sets the speed of the motorized wheels [102] accordingly, providing safe and stable walking assistance to the user. Further, it also comprises a pressure sensor [106*b*] detecting the amount of pressure applied by the user holding the handles [104*a*] or [104*b*] while getting up or sitting down and walking. These pressure sensors [106*b*] help maintain the stability of the self propelled walker [100] and to detect when the user is in contact with the handle handles [104*a*] or [104*b*]. When the user's hands are not applying pressure to the handles [104*a*] or [104*b*] this frees the wheels [102] to turn, allowing the self propelled walker [100] to be manipulated freely when not in use, for example; being pulled into position by an assistant. For providing much of the stability the given invention is provided with at least one wheel [102] on all the four sides in contact with ground. The wheel(s) is motorized and connected to a motor [106*a*] providing free self directed movement of the wheels [102] after the user gives command via the computing unit [108] wherein this computing unit [108] is further provided with a display, wherein this display is provided with many command options and statistics; like time, speed, distance or place wherein the scope of this is not limited. Through the computing unit [108] the user is also able to adjust the height and width of the self propelled walker [100] to customize the walker size to their preferred dimensions. The user is also able to initiate automatic folding, to fold the self propelled walker [100] into its most compact size by use of the computing unit [108].

In another embodiment this invention of the self propelled walker [100] also enables following commands by a person not directly using the walker, such as an assistant, who is able to give commands to the walker in order to assist the user.

While the invention has been described in detail with specific reference to preferred embodiments thereof, it is understood that variations and modifications thereof may be made without departing from the true spirit and scope of the invention.

What is claimed is:

1. A self propelled walker comprising:

a body comprising at least one wheel coupled to at least one contact point to the ground, the at least one wheel being coupled to a motor;

at least one handle coupled to the body, the at least one handle providing ergonomic positioning for a user;

a computing unit coupled to the at least one handle, the computing unit enabling commands to the self propelled walker;

at least one sensor coupled to the at least one handle, the at least one sensor providing data to the computing unit; and the computing unit being able to adjust a length and a width of the self propelled walker according to the user's need.

2. The self propelled walker in claim 1 comprising:

the at least one wheel being couple to the at least one point of contact to the ground enabling automatic movement of the self propelled walker via the commands provided by the computing unit.

3. The self propelled walker in claim 1 comprising:

the computing unit enabling a locking mechanism providing a stable support to the self propelled walker.

4. The self propelled walker in claim 1 comprising:

the at least one sensor being either a motion sensor or a pressure sensor.

5. The self propelled walker in claim 4 comprising:

the motion sensor detecting a movement speed of the user and the pressure sensor detecting a pressure applied on the at least one the handle by the user.

6. The self propelled walker in claim 1 comprising:

the at least one handle comprising a higher and a lower set of handles.

7. The self propelled walker in claim 1 comprising:

the motor being either a mechanical motor or an electrical motor.

8. A self propelled walker comprising:

a body comprising at least one wheel coupled to at least one contact point to the ground, the at least one wheel being coupled to a motor;

at least one handle coupled to the body, the at least one handle providing ergonomic positioning for a user;

a computing unit coupled to the at least one handle, the computing unit enabling commands to the motor coupled to the at least one wheel enabling a locking mechanism of the self propelled walker;

at least one sensor coupled to the at least one handle, the at least one sensor enabling stable and safe walking for the user; and the computing unit being able to adjust a length and a width of the self propelled walker according to the user's need.

9. The self propelled walker in claim 8 comprising:

the at least one wheel couple to the at least one contact point on the ground enabling automatic movement of the self propelled walker via the commands provided by the computing unit.

10. The self propelled walker in claim 8, wherein comprising:

the computing unit enabling the locking mechanism providing a stable support to the self propelled walker.

11. The self propelled walker in claim 8, wherein comprising:

the at least one sensor being either a motion sensor or a pressure sensor.

12. The self propelled walker in claim 11 comprising:

the motion sensor detecting a movement speed of the user and the pressure sensor detecting a pressure applied to the at least one handle by the user.

13. The self propelled walker in claim 8, wherein comprising:

the at least one handle comprising a higher and a lower set of handles.

14. The self propelled walker in claim 8 comprising:

the motor is either a mechanical motor or an electrical motor.

* * * * *